US005470109A

United States Patent [19]

Grande

[11] Patent Number: 5,470,109

[45] Date of Patent: Nov. 28, 1995

[54] ADJUSTABLE BOOK JACKET AND METHOD FOR MAKING SAME

[76] Inventor: Dennis Grande, 7 Bigham Trail, Park Ridge, N.J. 07656

[21] Appl. No.: 372,062

[22] Filed: Jan. 12, 1995

[51] Int. Cl.[6] ..... B42D 3/04

[52] U.S. Cl. ..... 281/34; 281/29; 281/19.1

[58] Field of Search ..... 281/18, 19.1, 20, 281/29, 31, 35

[56] References Cited

U.S. PATENT DOCUMENTS

| | | | |
|---|---|---|---|
| 713,176 | 11/1902 | Thomas et al. | 281/34 |
| 2,311,153 | 1/1941 | Carlo . | |
| 5,013,068 | 5/1991 | Maldonado | 281/34 |
| 5,092,630 | 3/1992 | Ostrowski | 281/31 |
| 5,158,325 | 10/1992 | Landis et al. . | |
| 5,219,437 | 6/1993 | Moor et al. | 281/34 |

FOREIGN PATENT DOCUMENTS 3-26432 2/1991 Japan .

*Primary Examiner*—Willmon Fridie
*Attorney, Agent, or Firm*—W. Patrick Quast

[57] ABSTRACT

An adjustable book jacket for covering 100% of the external surface area of book covers in a wide range of book sizes is disclosed. A LYCRA-spandex fabric is cut in a unique diamond shaped pattern which eliminates waste fabric during production, and assures that the differential X and Y axis stretch characteristics of the fabric are properly located on the book jacket. Books of various size are neatly and snugly covered without visible seams, including the external spine portion of the book cover which is secured by the unique spine corner locking mechanism inherent in the combination of the diamond shaped pattern and the two way differential stretch nature of the fabric.

16 Claims, 6 Drawing Sheets

ADJUSTABLE BOOK JACKET AND METHOD FOR MAKING SAME

BACKGROUND

This invention relates to book jackets to cover books, periodicals, and the like and in particular elastic book jackets capable of expanding in both width and length to adjust to books larger in size to the original, relaxed size of the book jacket.

Some types of hard cover books, as, for example, school textbooks often require the individuals dealing with these books to provide a neat covering for the book. Typically this is accomplished by cutting a suitable wrapping paper into various sized pieces, and then utilizing adhesive tape to secure the pieces together to form a covering for a book. Obviously this time consuming and less than convenient book covering method can be improved upon with economical, ready made adjustable book covers.

Of course, attempts have been made to provide adjustable jackets for books as is evidenced by U.S. Pat. No. 2,311,153. This patent discloses making a book jacket out of strips of a two-way stretch elastic material stitched together with relatively inelastic sections of cloth or paper. A stiffening element 50 (FIG. 1) aids in preventing sagging. The jacket is designed to accommodate books ranging between 7¾"× 1¼" to 9"×6½"×3".

Again in U.S. Pat. No. 5,092,630 a protective, adjustable book jacket is disclosed. In this invention a closed loop of elastic material 26 (FIG. 1) is enclosed within side hems in a jacket for a book, the purpose being to permit snug adjustment of the book jacket to fit the book which is to be covered.

And in U.S. Pat. No. 5,158,325 and adjustable book jacket is disclosed, capable of being fabricated from a single piece of an elastic material such as nylon or spandex. To form the jacket the material is folded in two, sewn about its peripheral edges, and a slit is then made through the width of the jacket at the middle of the jacket. In this manner left and right pockets are formed which can then be secured over book covers of varying size. In addition the invention disclosed a built-in book marker as part of the jacket.

While these inventions provide useful conveniences in covering a range of book sizes, they do not fully address the problems solved by the instant invention. The disclosure herein describes an elastic book jacket that seamlessly covers 100% of the external area of the hard cover provided with the book itself within a range of book sizes approximately equal in size or larger than the relaxed, original size of the book jacket of the invention. In addition, a simple and economical method for making the book jacket of the invention is disclosed.

It is therefore a primary object of the invention to provide an economical, adjustable book jacket.

A further object of the invention is to provide a seamless, adjustable book jacket for covering the external surfaces of hard covered books.

Still another object of the invention is to provide an adjustable book jacket which covers 100% of the external surfaces of a range of book sizes equal to or larger than the original, relaxed size of the book jacket of the invention.

An additional object of the invention is to provide an adjustable book cover capable of being elastically adjusted to cover book covers substantially greater in width and length from the original, relaxed size of the book jacket of the invention.

Another object of the invention is to provide an adjustable book jacket fabricated from a pattern which virtually eliminates waste material during fabrication.

SUMMARY

These and other objects are obtained with the adjustable book jacket of the invention. A pattern has been devised for cutting the book jacket out of a single sheet of a suitable material. The material must be capable of substantial elongation in both its X and Y axis, and be sturdy and washable in order to be capable of reuse over a period of time on books of varying sizes. A suitable material would be, for example, a latex-spandex material. This material contains LYCRA together with nylon or cotton. A material having this description is available from E. I. du Pont de Nemours & Company.

Objections to previous adjustable book jackets overcome by the instant invention include the unsightly appearance of exterior stitching and unappealing geometric design, which would not allow one standard sized cover to completely cover a book without making adjustments for the thickness and size of the book. In the instant invention a diamond shaped pattern has been discovered to offer an extremely economical and useful method for creating a book jacket. After the diamond shape has been cut out of a roll or suitable elastic material, with the horizontal points of the diamond being further apart than the vertical points of the diamond so that the diamond shape has a somewhat greater length than width, a cut line is made a spaced distance from the vertical points of the diamond shape towards the center point of the diamond shape so that when the top and bottom portion of the diamond shape (containing the vertical points) to the left and right of each cut line are folded towards each other the vertical points of the diamond shape and the center point now substantially coincide. Now folding the left and right single sheet sides of the diamond shape (containing the horizontal points) inwardly towards the center point so that the horizontal points of the diamond shape and the center point substantially coincide, creates a rectangularly shaped potential book jacket having front and back portions. The front portion contains six triangularly shaped sections, three to the left of the cut line between the vertical points of the diamond shape, and three to the right. Left and right pockets are now formed in the front portion for securing the covers of a book by simply stitching together two open seams of the left hand triangles and the right hand triangles, exclusive of the original cut line, i.e. from the top left hand corner of the now rectangularly shaped front panel to the meeting point of the original vertical and horizontal points of the diamond shape, with a similar stitching between the bottom left hand corner of the front panel to the center point, and repeating this stitching operation on the three triangles now forming the right hand front portion of the book jacket.

This simple fabrication procedure, utilizing the spandex fabric described above, creates a unique adjustable book jacket for neatly decorating and protecting a wide range of book sizes. Books are adequately covered up to a 300% larger area relative to the surface area covered by the jacket of the invention in its unexpanded state. For example, if the original size of the beginning diamond shape pattern were 26" in length by 14" in width, and the cut lines from the top and bottom vertical points of the diamond shape were 3 ½ " in length towards the center point of the diamond shape, the resulting fabricated adjustable book jacket would measure 7" in width by 13" in length. This basic sized jacket will then accommodate books of varying sizes up to 14" in width, and up to 30" in length. For books of smaller sizes, a smaller beginning sized jacket would be necessary, as, for example, 4"×9". The unique, stitched together triangular shapes of the "pockets" in the book jacket provide for grasping the top and bottom spine sections of the book in a positive and affirmative manner. Whether the book is opened or closed the book jacket continues to provide a 100% snug, seam-free fabric covering over the entire outer surface of the book cover. Within the range of sizes covered by the jacket, as larger sizes of books are placed within the jacket, this unique triangular stitching insures the top and bottom corners of the book jacket at each of the four corners of the spine securely lock onto the spine of the book, thereby eliminating unsightly "gaps" in covering the outer spine of the book which occurs with other types of construction. This specific rectangular shape, with triangularly shaped stitched pockets in the jacket does not permit any substantial alteration without destroying the ability of jacket of the invention to fully and seamlessly cover the outer surface of a wide range of differently sized books. As will be more fully discussed moving the meeting point of the four points of the diamond shape either vertically up or down, or horizontally left or right any substantial distance from the structure described above effectively destroys this essential spine locking feature of the invention.

The LYCRA-spandex material envisioned above is a preferred material of fabrication. The material can be supplied in rolls of 60", 96" and 98" in width, with a 2" additional "salvage" material along the width of the roll. The LYCRA-spandex material is typically "tricot" stitched, i.e. warp weaved, and will stretch differently in different directions. For example, the axis which is collinear with the material on a roll will provide a stretch of 290%, whereas the axis which is perpendicular to that axis on a roll will provide a stretch of 200%. It is important that the book jacket pattern be cut on the roll so that the maximum stretch of the material is found in the length of the pattern. The dimensions of the diamond shaped pattern for the book jacket of the invention, i.e. 26" in length×14" in width, while providing a practical size for the jacket also provides for maximum efficiency in utilizing a 62" wide roll in that patterns are cut with virtually no waste of material as will be more fully explained.

Thus a specific structurally shaped pattern for fabricating an adjustable book jacket that will provide a jacket which seamlessly and fully covers the externally exposed covers of books, whether in open or closed position, is disclosed. The described material of fabrication has excellent expansion characteristics in both its X and Y axis, and is tough to resist tearing, and repeated washing if required. The book jacket can be supplied in a multitude of colors, with various designs, lettering, etc., applied thereon. The jackets are easily slipped on various sized books, and easily removed as required. Self sticking labels can be applied or school logos ironed on, and so on, to individualize the use of the jackets.

While the above description of the invention specifies specific materials of fabrication, various suitable elastic fabric materials can be similarly employed. The specific structural shapes for the adjustable book jacket described above will be more fully discussed as to the variations permissible within the scope of the invention.

DETAILED DESCRIPTION

Figure 1:
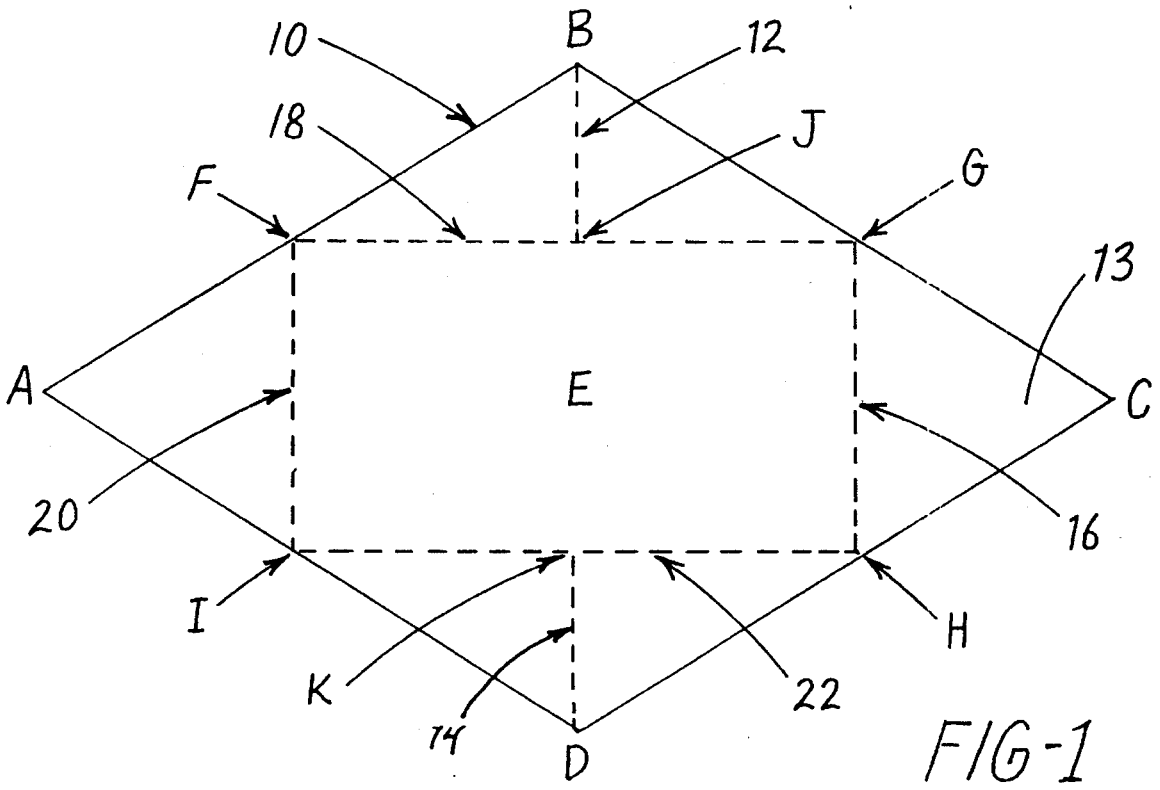
FIG. 1 is a top plan view of a suitable pattern for fabricating the adjustable book jacket of the invention.

Turning now to the drawings, in FIG. 1 a fabric cut out 10 of a pattern for the adjustable book jacket 11 (FIG. 2) of the invention is depicted, A spandex type of fabric material 13 capable of substantial expansion along both its X (length) and Y (width) axis (FIG. 7) is required. The material 13 is fabricated by what is known in commercial fabric production as a "tricot stitch" or warp knit which produces a spandex type material with a stretch potential of up to 290% in one direction (X axis), and a stretch of up to 200% in a second direction (Y axis). This differential stretching ability of the fabric employed is essential to produce 100% external covering of books of varying sizes with the spine locking mechanism of the invention, which will be more fully discussed. A LYCRA-spandex material having the above described characteristics is available from the E.I. dupont deNemours & Company. Materials of this type are conventional and well known to the art.

Figure 2:
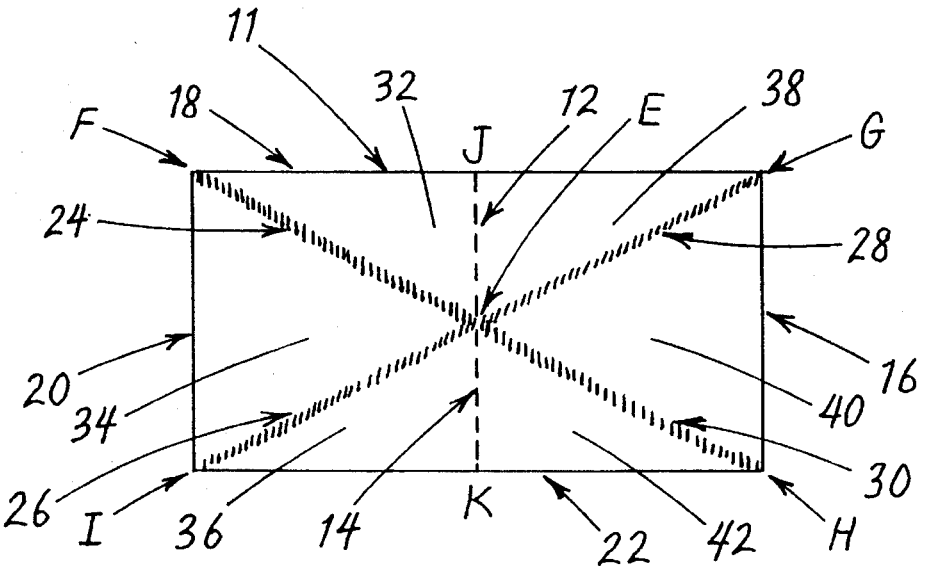
FIG. 2 is a perspective view of a version of the adjustable book jacket of the invention.

The diamond shaped (A,B,C,D) fabric cut out of FIG. 1 lends itself perfectly to the adjustable book cover of the invention. Points F,G, H, and I on the periphery of the diamond shape and dotted lines 18 (between points F and G), 16 (between points G and H), 22 (between points H and I), and 20 (between points F and I), define a rectangular shape within the diamond shaped cut out 10. To turn this fabric pattern cut out 10 into the book jacket of the invention the fabric 13 is cut along dotted line 12 (between points B and J), and a second cut is made along dotted line 14 (between points D and K). To complete the book jacket the material 13 is now folded along dotted lines 18, 16, 20, and 22 to form the rectangular shaped book jacket 11 as shown in FIG. 2. This folding operation creates three left hand triangularly shaped sections (37, 34, 36) and three right hand triangularly shaped sections (38, 40, 42) which now comprise the front panel of the book jacket 11. The four open seams of these triangular shapes exclusive of the cut lines 12, 14 now running down the middle portion of the front panel are now stitched together to form four lines of substantially diagonally directed stitching (24, 26, 28, 30) between the corners (F, G, H, I) of the rectangular shaped jacket 11 and a point E at the center of the rectangular shape. The three left hand triangular shapes (32, 34, 36), and the three right hand triangular shapes (38, 40, 42) together with the back portion 44 (FIG. 3) of the jacket, now form left and right hand "pockets" for the covers of books of various sizes.

It should be noted that a particular dimension for this diamond shaped pattern fabric cut out 10 is especially practical for the book jacket of the invention. If, for example, the length (A–C) of the diamond shape of FIG. 1 is approximately 26" and the width (B–D) is approximately 14", and the two cut lines (12, 14) measure approximately 3½" in length (B–J, K–B) each, then the resulting rectangularly shaped book jacket 11 of FIG. 2 will have a length along its top 18 and bottom 22 periphery of approximately 13" and a width along its left 20 and right 16 peripheral edges of approximately 7". This 7"×13" size corresponds well to a usually minimal sized hard cover book, and makes an excellent beginning dimension for an adjustable book jacket for covering an extremely wide selection of possible book covers. The above given dimensions also permits an ideal placement of the pattern cut out on a typical fabric roll for both correct placement of stretch characteristics of the fabric material 13, and also for the elimination of waste during fabrication as will be more fully explained.

Figure 3:
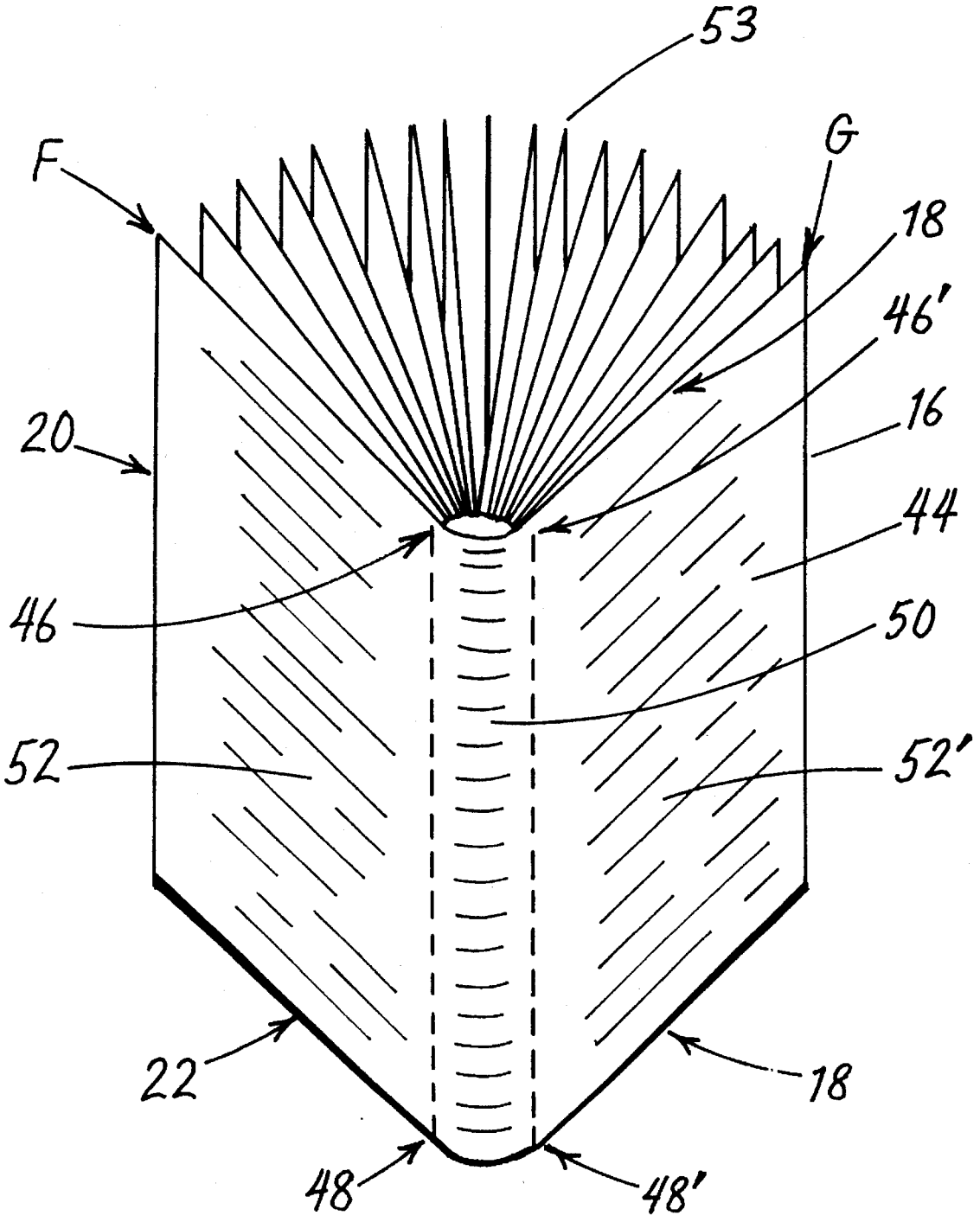
FIG. 3 is a rear view illustrating the adjustable jacket of FIG. 2 in place covering the outer surface of a typical book.
Figure 4:
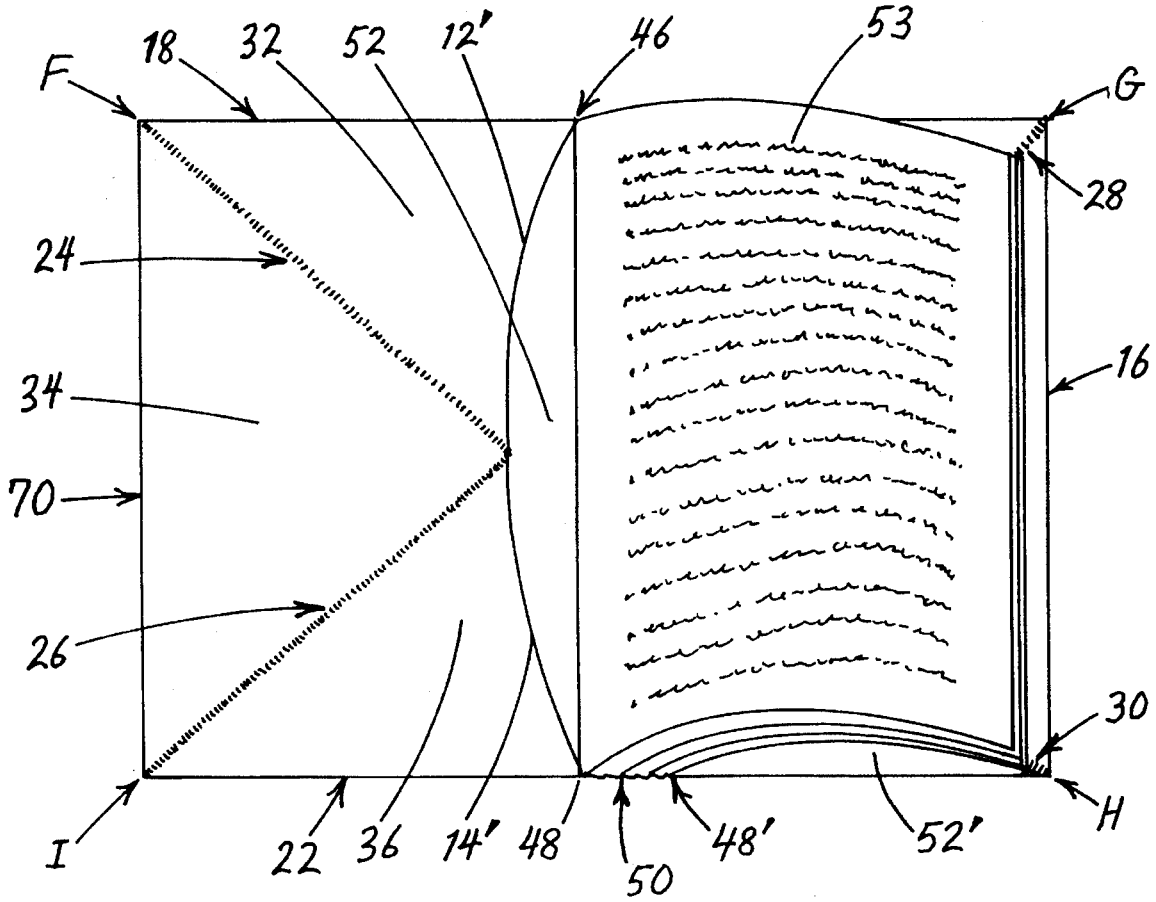
FIG. 4 illustrates the triangular stitching pouch construction of the adjustable book jacket of the invention, securing the covers of a typical book.

Placement (not shown) of the book jacket on a typical book is easily accomplished by placement of the book with the pages face down, bending the book covers back, and working the left and right hand pockets of the book jacket over the covers until a snug fit is obtained. Removal is accomplished with equal ease. FIGS. 3 and 4 depict the adjustable book jacket 11 in place on a typical book having a spine portion 50, a left cover 52, right cover 52', and pages 53.

In FIG. 3 the spine 50 of the book is shown completely covered due to the two spine locking features 46, 46' of the jacket at the top of the spine, and the two spine locking features of the jacket 48, 48' at the base of the spine. This is an essential feature of the book jacket of the invention showing a neat, snug, stitch free external book cover covering 100% of the external cover of the book, including completely covering the spine 50. FIG. 3 clearly depicts the spine locking feature of the book jacket 11. Even in a highly expanded condition wherein the left hand side 12', 14' of the original cut line 12, 14 is shown pulled away from the center point E of the original rectangular shape, the two lines of stitching 24, 26 on the front portion of this left hand pocket of the jacket causes the jacket 11 to grasp the corners of the spine 46, 48, 48' (46' not shown) in a positive and affirmative way. The manner in which the pattern for the fabric is cut out of the roll (FIG. 7) insures that a greater amount of potential stretch of the fabric 13 is present along the length of the pattern cut fabric 10 than across the width so that the greater and lesser stretch potentials cooperate with the two stitch lines in each of the pockets of the jacket to insure secure locking of the jacket onto the four corners of the spine. In this manner a seam free, snug, 100% covering of the external surface of the book cover is assured with the jacket over a wide range of book sizes, and whether the book is in open or closed position.

Figure 5:
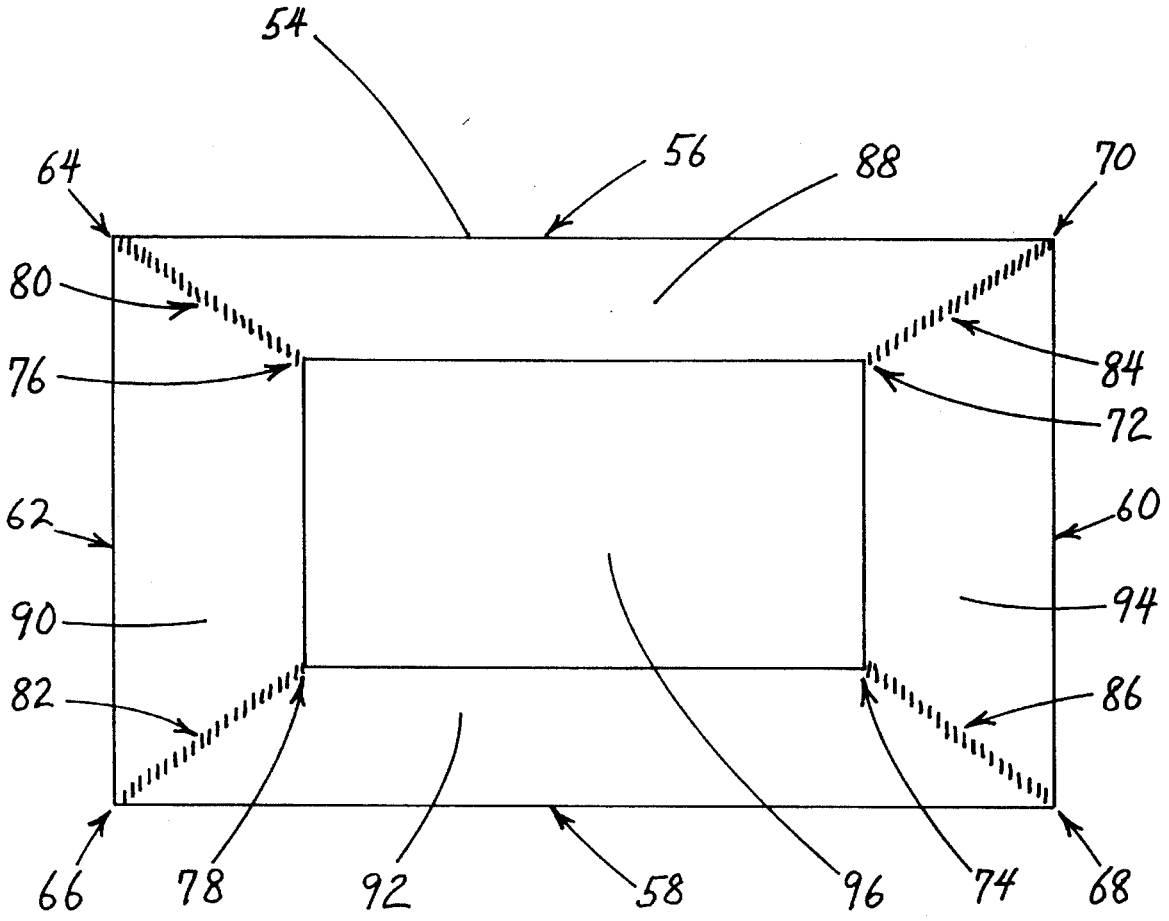
FIG. 5 is a top plan view of a different construction of an adjustable book jacket lacking the spine locking feature of the invention.
Figure 6:
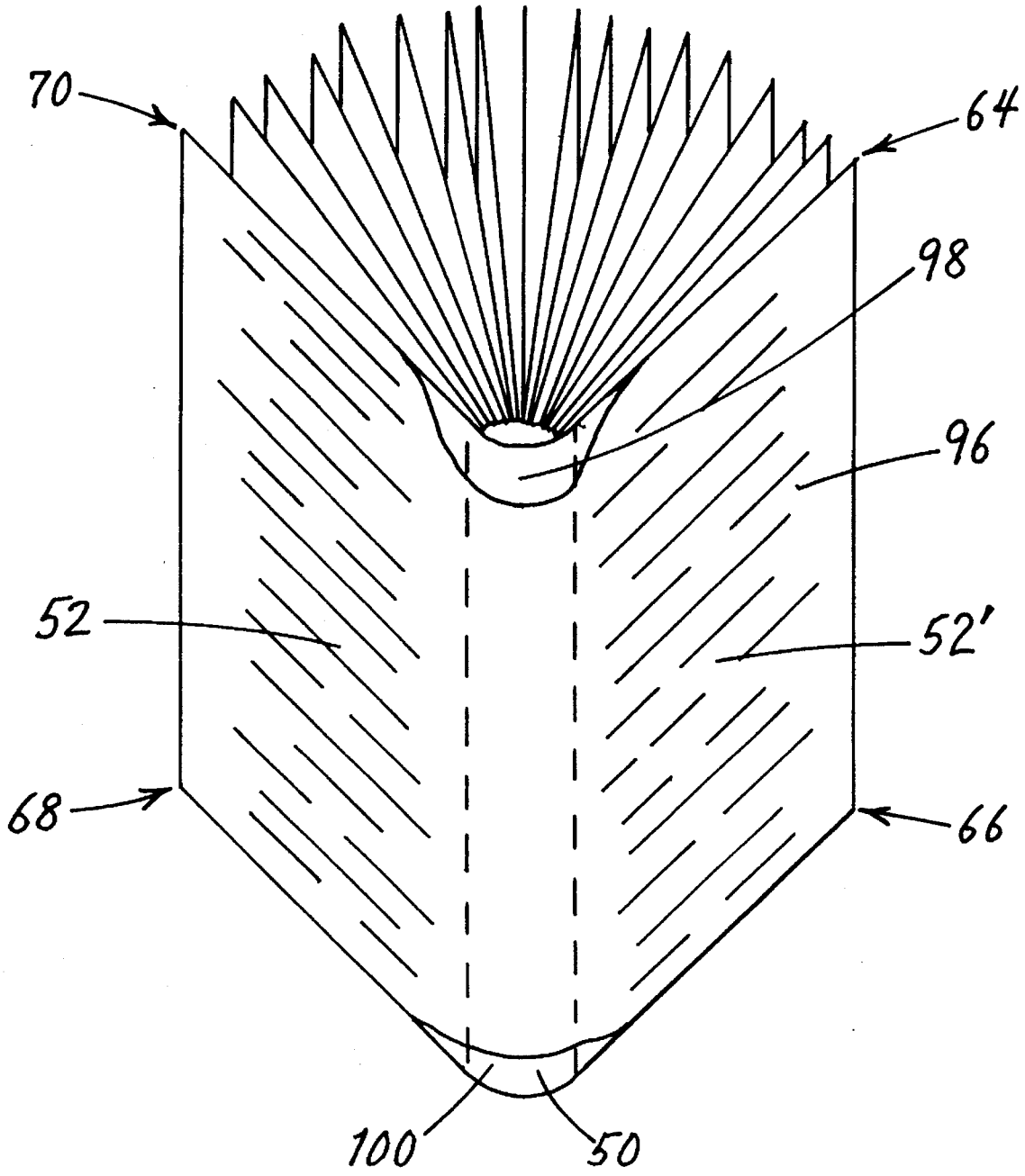
FIG. 6 is a rear view illustrating the adjustable book cover of FIG. 5 in place, only partially covering the outer surface of a typical book.

It is to be noted that the diamond shaped pattern cut out fabric 10 of FIG. 1 which forms the jacket of FIG. 2 is not amenable to substantial alteration in structure, as illustrated in FIGS. 5 and 6. For example, if the apex of the three triangular shapes 32, 34, 36 comprising the left portion of the front panel were shifted from the center E of the rectangular shape towards the left hand periphery 20 of the rectangular shape along a line through the center point E and parallel to the top 18 and bottom 22 peripheries of the rectangular shape a distance of 25% of the distance shown in FIG. 2, or if the apex of the three triangular shapes 38, 40, 42 comprising the right portion of the front panel were shifted similarly from the center E towards the right hand periphery 16 of the rectangular shape a distance in excess of 25% of the distance between the center point and the right hand periphery 16, the spine locking feature of the invention would be defeated. Similarly if the cut lines 12 , 14 were lengthened in one direction and shortened in the second direction so that the apexes of the triangles forming the front portion of the jacket were raised towards the top of the rectangular shape or lowered towards the bottom peripheral edge of the rectangular shape a distance in either direction greater than 25% of the distance shown in FIG. 2, the spine locking feature of the invention would be lost. In FIG. 5 a second possible structure for an adjustable book jacket 54 is shown. An identical outer rectangular shape to that depicted in FIG. 2 is shown having a top peripheral edge 56, a bottom peripheral edge 58, a left peripheral edge 62, and a right peripheral edge 60. The back portion 96 of this jacket 54 is a solid piece of fabric, with the front of the jacket 54 being formed by four trapezoidally shaped sections 88, 94, 92, 90. Two lines of stitching 80, 82 connect the left hand top 64 and bottom 66 corners to the left hand top 76 and bottom 78 corners of the internal rectangular shape formed by the trapezoidal folds 88, 90, 92, 94 forming the front of the jacket 54. Similarly two lines of stitching 84, 86 connect the right hand top 70 and bottom 68 corners to the left hand top 72 and bottom corners 74 of the internal rectangular shape formed by the trapezoidal folds 88, 90, 92, 94. While this structure actually has a larger quantity of fabric at the top peripheral section and the bottom peripheral section as compared to the jacket 11 depicted in Fig. 2, when placed on an identical book as in FIG. 3, the spine locking feature of the invention is lost. As shown in FIG. 6 this second jacket 54 fails to provide complete coverage of the external area of the book cover, since it does not lock onto the corners of the spine, resulting in unsightly uncovered areas 98, 100 at the top and bottom of the external area of the spine 50 of the book cover.

Figure 7:
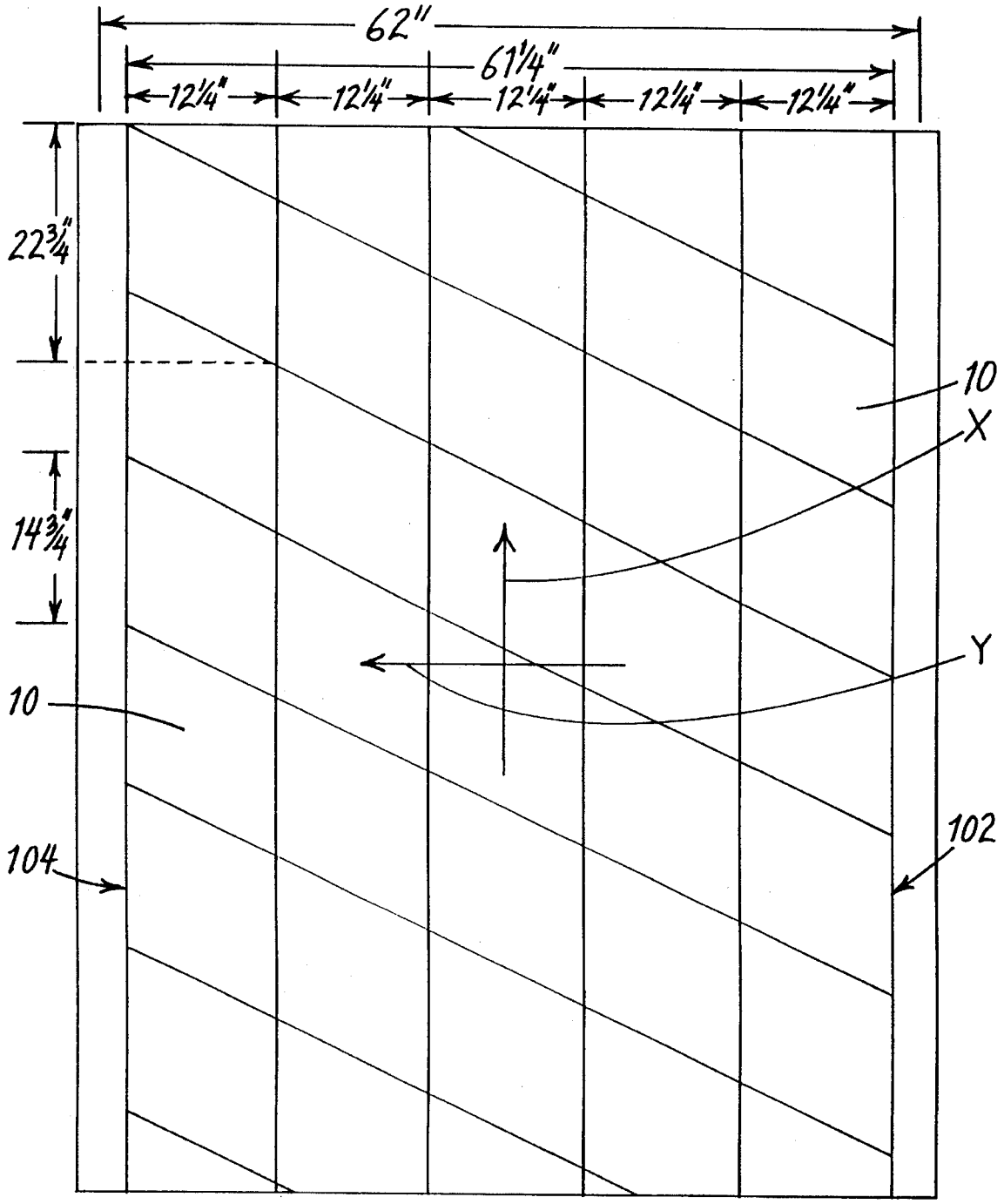
FIG. 7 is a schematic representation of patterns of the adjustable book jacket of the invention imposed on a typical roll of a suitable elastic material, illustrating maximum efficiency in material utilization.

FIG. 7 is a schematic depicting the specifically sized equilateral quadrilateral diamond shaped pattern 104, i.e. 26" in length×14" in width, placed on a 62" wide roll of a suitable spandex material. As can be seen the diamond shape is offset on the bias approximately 30 degrees so that the cut out diamond shaped fabric 10 has the greatest stretch potential across the length of the diamond shape, and the lesser stretch potential across the width of the diamond shape, since typically the greatest potential stretch in the fabric 13 would be collinear with the fabric on the roll (X axis), while the lesser potential stretch in the fabric would be perpendicular to this direction (Y axis). The unique advantage of this pattern placement is twofold: (1) the resulting adjustable book jacket maintains the correct differential stretch potential along both the X and the Y axis of the book jacket to assure effective locking of the book jacket to the corners of the spine of books of varying size. (2) the dimensions of a 7"×13" sized book jacket provides for cutting 5 book jackets out of each width of a 62" roll of fabric with virtually no residual fabric waste material, which obviously provides substantial economies in fabrication.

It can thus be seen that the adjustable book jacket of the invention provides an economical yet aesthetically superior book jacket for covering a wide range of differently sized books. The unique diamond shaped pattern provides for an extremely simple, waste free, and economical fabrication. The resulting book jackets neatly and snugly cover 100% of the external surface area of a book cover, and do so in an attractive, seamless manner. The common failure of other types of jackets in either providing an excess of material to fully cover the external spine of the book cover, or to allow portions of this external spine to show in an unattractive manner, is completely overcome by the unique spine locking feature the unique diamond shape and two way differential stretch nature of the fabric cooperate to provide.

While the present invention has been disclosed in connection with versions shown and described in detail, various modifications and improvements thereon will become readily apparent to those skilled in the art. Accordingly, the spirit and scope of the present invention is to be limited only by the following claims.

What is claimed is:

1. An adjustable book jacket, comprising:

(a) said jacket being fabricated in an elastic material;

(b) said jacket having a front panel and a back panel;

(c) said jacket being rectangular in shape, said rectangularly shaped jacket having a top and a bottom, and a left side and a right side, said rectangular shape being defined by a fold line around the periphery of said rectangular shape;

(d) said front panel having an open seam extending substantially the full latitudinal width of said front panel so as to form a left hand pocket and a right hand pocket for the placement therein of a left hand and right hand cover of a book;

(e) said left hand pocket having two seams stitched closed, a first one of said two left hand pocket seams being located between a beginning point on the top left hand corner of said rectangular shape stitched closed in a substantially diagonal direction to an end point on a first edge of said open seam, and a second one of said two left hand pocket seams being located between the bottom left hand corner of said rectangular shape stitched closed in a substantially diagonal direction to an end point on said first edge of said open seam;

said right hand pocket having two seams stitched closed, a first one of said right hand pocket seams being located between a beginning point on the top right hand corner of said rectangular shape stitched closed in a substantially diagonal direction to an end point on a second edge of said open seam, and a second one of said two right hand pocket seams being located between the bottom right hand corner of said rectangular shape stitched closed in a substantially diagonal direction to an end point on said second edge of said open seam, so that books having a spine and two covers, said combination of book spine and covers having the same or greater widths and lengths as said jacket can be covered by said jacket, said covers of said books being placed within and covered by said pockets within said jacket, said jacket covering the outer, exposed area of said covers and said spines of said books.

2. The adjustable book jacket according to claim 1 wherein said end points of said stitched seams on said first and said second edges of said open seams are located at least 75% of the distance between the center point of said rectangular shape and a point located at the middle along the longitudinal length of said top of said rectangular shape, and at least 75% of the distance between said center point of said rectangular shape and a point located at the middle along the longitudinal length of said bottom of said rectangular shape.

3. The adjustable book jacket according to claim 2 wherein said end points of said stitched seams on said first and said second edges of said open seam are located at least 75% of the distance between the center point of said rectangular shape and a point located at the middle along the latitudinal width of said left side of said rectangular shape, and at least 75% of the distance between said center point of said rectangular shape and a point located at the middle along the latitudinal width of said right side of said rectangular shape.

4. The adjustable book jacket according to claim 1 wherein said end points of said stitched seams on said first and said second edges substantially coincide with the center point of said rectangular shape.

5. The adjustable book jacket according to claim 1 wherein said elastic fabric has greater stretch potential along an axis of said fabric designated the Y axis in comparison to an axis of said fabric designated the X axis.

6. The adjustable book jacket according to claim 5 wherein said stretch potential of said Y axis is approximately 290%, and said stretch potential of said X axis is approximately 200%.

7. The adjustable book jacket according to claim 5 wherein said elastic fabric is a woven fabric.

8. The adjustable book jacket according to claim 7 wherein said fabric is woven by a method known as "tricot stitching".

9. A method for fabricating an adjustable book jacket, comprising the steps of:

(a) selecting a suitable elastic fabric for fabricating said jacket;

(b) cutting a pattern out of said fabric, said pattern being in the form of an equilateral quadrilateral diamond shape, said diamond shape having four points at the periphery of said diamond shape, two of said points comprising the top and bottom of said diamond shape and the remaining two points comprising the left and right hand sides of said diamond shape, said top and bottom points comprising the width of said diamond shape and said left and right hand points comprising the length of said diamond shape, said diamond shape being greater in length than in width;

(c) creating a midline open seam in said pattern from both said top and bottom points of said diamond shape a spaced distance towards a point at the center of said diamond shape;

(d) folding said four points of said diamond shape inwardly towards each other and said center point of said diamond shape, forming a substantially rectangularly shaped potential adjustable book cover having a back portion and a front portion, a left side and a right side, and atop and bottom; and (e) stitching closed a first open seam in said front portion of said jacket extending between the top left hand corner of said rectangular shape and extending in a generally diagonal direction towards the center point of said rectangular shape, and stitching closed a second open seam in said front portion of said jacket extending between the bottom left hand corner of said rectangular shape and extending in a generally diagonal direction towards said center point of said diagonal shape, and stitching closed a first open seam in said front portion of said jacket extending between the top right hand corner of said rectangular shape and extending in a generally diagonal direction towards said center point of said rectangular shape, and stitching closed a second open seam in said front portion of said jacket extending between the bottom right hand corner of said rectangular shape and extending in a generally diagonal direction towards said center point of said rectangular; thereby (f) creating a left hand pocket and a right hand pocket in said front portion of said adjustable book jacket.

10. The method according to claim 9 further comprising the step of arranging for the ends of said stitched closed seams away from said corners of said rectangular shape and said center point of said rectangular shape to substantially coincide.

11. The method according to claim 9 in which the step of fabric selection includes the step of selecting a fabric which expands differentially along an X axis designated its length in comparison to a Y axis designated its width.

12. The method according to claim 11 further including the step of having said fabric expand approximately 290% along its Y axis and 200% along its X axis.

13. The method according to claim 12 further including the step of fabricating said selected fabric by "tricot stitching".

14. The method according to claim 10 further including the step of cutting said pattern approximately 23" in length× approximately 14" in width, and creating said midline open seam approximately 7" in width.

15. The method according to claim 12 further comprising the step of cutting said pattern from a fabric roll size selected from the group of 60" wide, 96" wide, and 98" wide.

16. The method according to claim 15 further comprising the step of imposing said pattern on said roll on a biased angle of approximately 30 degrees of said points defining said width of said pattern relative to a line perpendicular to the length of said roll of said fabric so that said Y axis of said fabric coincides with the length of said rectangular shape of said jacket, and so that said X axis of said fabric coincides with the width of said rectangular shape of said jacket.

* * * * *